US006102935A

United States Patent [19]

Harlan et al.

[11] Patent Number: 6,102,935

[45] Date of Patent: Aug. 15, 2000

[54] PACIFIER WITH SOUND ACTIVATED LOCATOR TONE GENERATOR

[76] Inventors: Penny Elise Harlan, 5838 W. Fallon, Fresno, Calif. 93625; David Huffman, 5838 W. Fallon, Frasno, Calif. 93625

[21] Appl. No.: 09/375,103

[22] Filed: Aug. 16, 1999

Related U.S. Application Data

[63] Continuation-in-part of application No. 08/902,059, Jul. 29, 1997, abandoned.

[51] Int. Cl.[7] ..... A61J 17/00

[52] U.S. Cl. ..... 606/234

[58] Field of Search ..... 606/234, 235, 606/236

[56] References Cited

U.S. PATENT DOCUMENTS 5,292,335 3/1994 Shin ..... 606/234

5,662,685 9/1997 Uhler ..... 606/234

*Primary Examiner*—Michael Buiz
*Assistant Examiner*—Vy Q. Bui
*Attorney, Agent, or Firm*—John D. Gugliotta

[57] ABSTRACT

A baby or infant pacifier is disclosed with a sound activated locator annunciator. Comprised of a nipple and associated components utilized on conventional pacifiers, the disclosed apparatus also utilizes a microphone and associated electronic circuitry to monitor for distinctive sound waveforms, such as the clapping of hands, that would normally be minimally found in an infant's or baby's immediate environment. When such a distinctive waveform is detected by the use of fuzzy logic, a speaker emits an audible locator signal, such as a musical tune or sound, for a predetermined time period to allow for location of the apparatus. It is intended that this audible locator signal will aid the care provider of the infant or baby in locating the pacifier when lost.

13 Claims, 3 Drawing Sheets

PACIFIER WITH SOUND ACTIVATED LOCATOR TONE GENERATOR

RELATED APPLICATIONS

The present invention is a Continuation-in-Part of Ser. No. 08/902,059, filed on Jul. 29, 1997, and now abandoned.

BACKGROUND OF THE INVENTION

1. Field of the Invention

The present invention relates generally to infant teething and pacifier devices and, more particularly, to a child's pacifier having an imbedded sound activated locator tone such that when the pacifier is lost or misplaced a locator tone can be activated in a remote fashion.

2. Description of the Related Art

In several related arts, many methods of locators are known, as well as many types of infant pacifiers. A search of the prior art did not disclose any patents that read directly on the claims of the instant invention; however, the following references were considered related:

| U.S. Pat. No. | Inventor | Issue Date |
|---|---|---|
| 5,292,335 | Jong-Hyun Shin | Mar. 8, 1994 |
| 5,211,479 | Frank Coffey | May 18, 1993 |
| 5,033,864 | Marie R. Lasecki, et al. | Jul. 23, 1991 |
| 5,008,954 | Carl Oppendahl | Apr. 16, 1991 |
| 4,788,734 | Gerfreid Bauer | Apr. 16, 1991 |
| 4,554,919 | Claudette Hubert | Nov. 26, 1985 |

In U.S. Pat. No. 5,292,335, an infant pacifier with diaphragm melody generator is disclosed that generates a melody when the infant holds the pacifier in the mouth and sucks or mumbles.

In U.S. Pat. No. 5,211,479, a digital pacifier thermometer is disclosed having one or more electrical sensors within the pacifier nipple and digital measurement and display units external to the nipple.

In U.S. Pat. No. 5,033,864, a temperature sensing pacifier, similar to the '479 patent, is disclosed including a radio transmitter and receiver for remotely indicating the sensed temperature.

In U.S. Pat. No. 5,008,954, a voice activated ratio transceiver is disclosed. Although not directly related to the present invention, the voice activated functionality of the '954 patent shares parts of the functionality of the present invention.

In U.S. Pat. No. 4,788,734, a toothbrush having signal producing means in an audible range is disclosed.

In U.S. Pat. No. 4,554,919, a musical pacifier is disclosed, similar to the '335 patent, but including an electronic programmed circuit capable of generating signals to produce a musical tune.

Although these incremental improvements in the art provide various functionalities, none appear capable of aiding a user in finding a lost or misplaced pacifier. Consequently, a need has been felt for providing a musical pacifier with a remote locator means.

SUMMARY OF THE INVENTION

It is therefore an object of the present invention to provide an improved pacifier with sound activated locator tone.

It is therefore another object of the present invention to provide for the ease of location of the pacifier when the pacifier is lost or misplaced.

It is a feature of the present invention to provide an improved pacifier otherwise similar to a standard pacifier, except including a sound chip embedded in the pacifier's handle.

It is another feature of the present invention to allow for its low cost manufacture by readily available methods and commonly available materials.

Briefly described according to one embodiment of the present invention, a baby or infant pacifier is disclosed with a sound activated locator annunciator. Comprised of a nipple and associated components utilized on conventional pacifiers, the disclosed apparatus also utilizes a microphone and associated electronic circuitry to monitor for distinctive sound waveforms, such as the clapping of hands, that would normally be minimally found in an infant's or baby's immediate environment. When such a distinctive waveform is detected by the use of fuzzy logic, a speaker emits an audible locator signal, such as a musical tune or sound, for a predetermined time period to allow for location of the apparatus. It is intended that this audible locator signal will aid the care provider of the infant or baby in locating the pacifier when lost.

An advantage of the present invention is that when the pacifier is lost or misplaced, the chip will respond to voice or sound signals via the use of fuzzy logic and emit music or some sort of noise, allowing it to be located.

Another advantage of the present invention is that when the pacifier is lost or misplaced in a dimly lit environment such as when the infant or baby is sleeping at night, the audible locator signal will allow for location of the pacifier without the need for increased lighting.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

1. Detailed Description of the Figures

Figure 1:
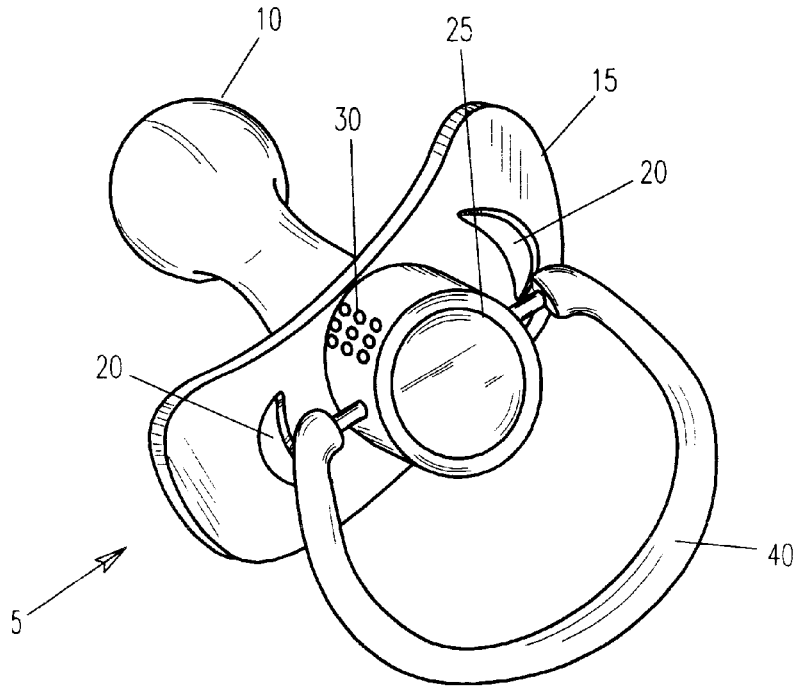
FIG. 1 is a perspective view of a pacifier according to the preferred embodiment of the present invention.

Referring now to FIG. 1, a pacifier with sound activated tone generator 5 in a perspective view is shown, according to a preferred embodiment of the present invention. A nipple 10 which is attached to a circular press base 15 in a conventional manner is provided for sucking comfort of infants and babies. A pair of arched openings 20 are provided to aid in the suction breaking when removing the pacifier with sound activated tone generator 5 from the infant's or baby's mouth. A circular electronics housing area 25 is provided for housing of the electronic circuitry which will be described in greater detail below. Arranged around the outer circular portion of the circular electronics housing area 25 are a plurality of sound openings 30 in a linear array to aid in allowing sound waves to both enter and leave the circular electronics housing area 25. Optionally attached to the circular electronics housing area 25 is a handle 40. The handle 40 is to be used in the insertion and removal of the pacifier with sound activated tone generator 5 from the baby's or infant's mouth. It is anticipated that the nipple 10 would be manufactured from latex or silicone and the remaining exterior components such as the circular press base 15, the circular electronics housing area 25 and the handle 40 would be manufactured from injection molded plastic as found in conventional baby pacifiers. This choice of materials allows for low cost, safe, and sanitary conditions, which are easily manufactured by conventional means.

Figure 2:
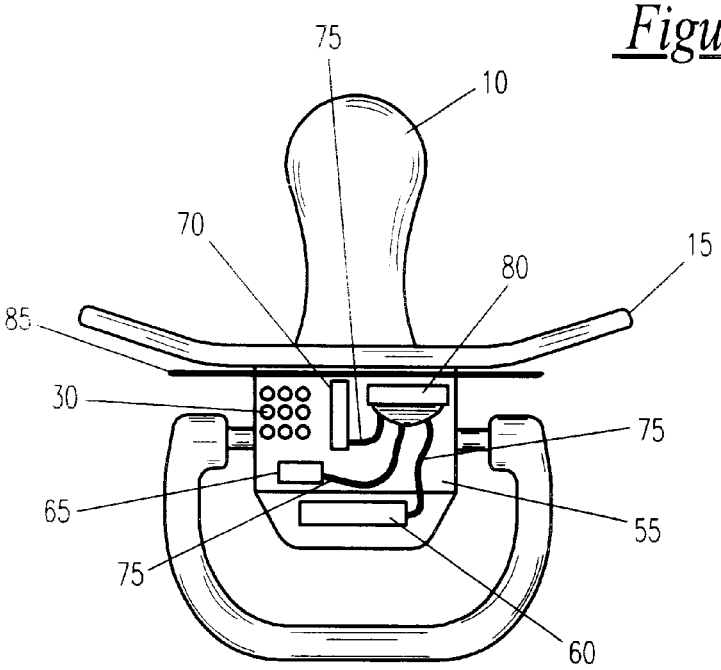
FIG. 2 is a cross sectional view thereof taken across the axial centerline and showing an internal cavity including a sound activated music generator chip.

Referring next to FIG. 2, a cross sectional view thereof taken across the axial centerline of the pacifier with sound activated tone generator 5, and showing an internal cavity 55 is disclosed. A battery 60 is located within the internal cavity 55. It is envisioned that the battery 60 is of the small electronic type currently utilized by watches, calculators and other small electronic appliances. Located in close physical proximity to the array of sound openings 30 is a microphone 65 and a speaker 70. A wiring harness 75 provides the necessary electrical connections between the battery 60, the microphone 65, the speaker 70 and an encapsulated electronics module 80. The encapsulated electronics module 80 contains all of the necessary electronics comprising amplifiers, timers, logic, fuzzy logic, etc. and will be described in greater detail below. It is envisioned that the encapsulated electronics module 80 will be of an integrated circuit design and of a potted nature to provide protection from possible wet or damp environments.

Figure 3:
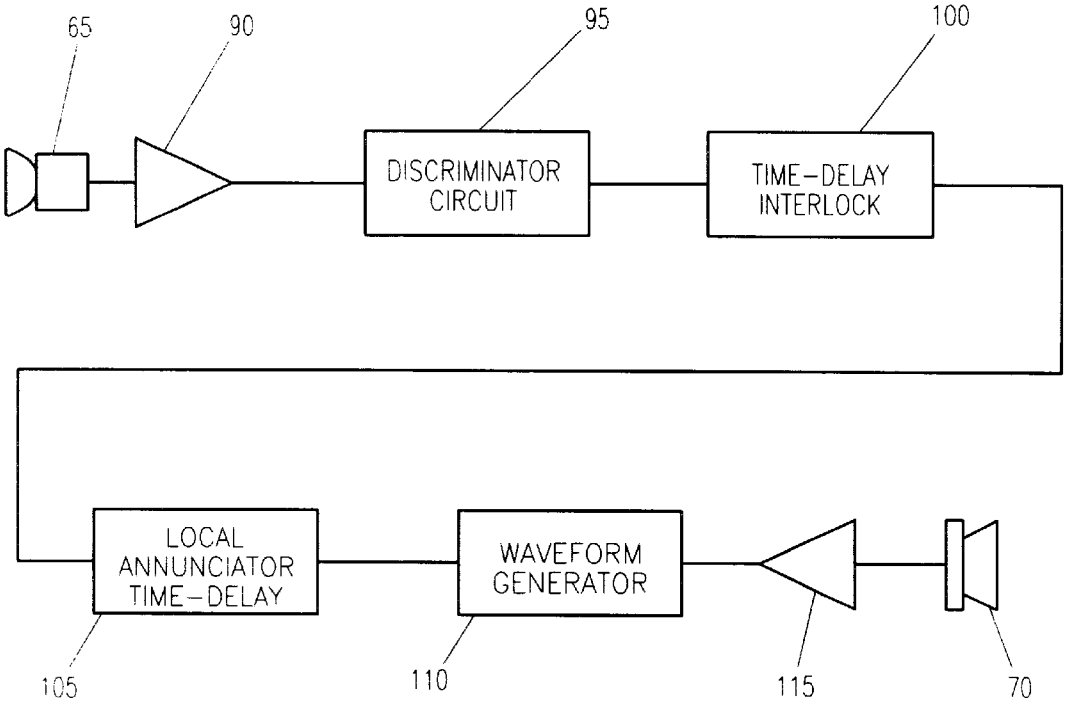
FIG. 3 a diagrammatic representation of the circuitry used to activate a musical tone generator via a remote sound trigger.

Referring now to FIG. 3 a diagrammatic representation of the circuitry used to activate an audio tone generator via a remote sound trigger is disclosed. The electronic output of the microphone 65 is amplified by a first amplifier 90. A discriminator circuit 95 monitors the amplified output for a sound wave of particular nature. It is envisioned that the desired sound wave would possess quick rise and fall times and have a large peak amplitude. Sounds of this nature include the clapping of hands or snapping of fingers. The discriminator circuit 95 utilizes fuzzy logic to allow for the detection of the desired trigger sound under less than ideal situations. Such situations include proper detection under high ambient noise conditions, such as during the day when other children or siblings may be playing nearby. Under these conditions, the parameters to allow triggering will be tighter or more stringent, but at night when it is quiet, lower levels or sounds spaced farther apart will allow for triggering. This will prevent false triggering during the day, and ease of triggering at night. Signals will be processed on a vague basis rather than a discrete basis with such factors as ambient noise, time last noise, sequence of signal, etc. which allow for a identical sounds which may be acceptable at some times but unacceptable at others. Such sound signals are, possibly are, or are not acceptable depending on other associated parameters when the sound is detected. The implementation of this fuzzy logic will be implemented using custom electronic chips using VLSI construction or chips utilizing RISC. Such construction and programming is well known in the art and not further elaborated here. When such a sound is detected by the discriminator circuit 95, a signal is then passed to a time-delay interlock 100. To avoid false triggers, the time-delay interlock 100 will only activate when two such signals are detected within a predetermined time period. The output activation signal of the time-delay interlock 100 is passed to a locator annunciator time delay 105. The locator annunciator time delay 105 in turn applies electrical power to a waveform generator 110 and a second amplifier 115 to produce an audible sound out of the speaker 70 for a predetermined time period on the order of 5 seconds. It is envisioned that the waveform generator 110 would allow the playing of a musical tune such as a child's lullaby or other similar noise such as not to be frightening to a baby or infant.

Figure 4:
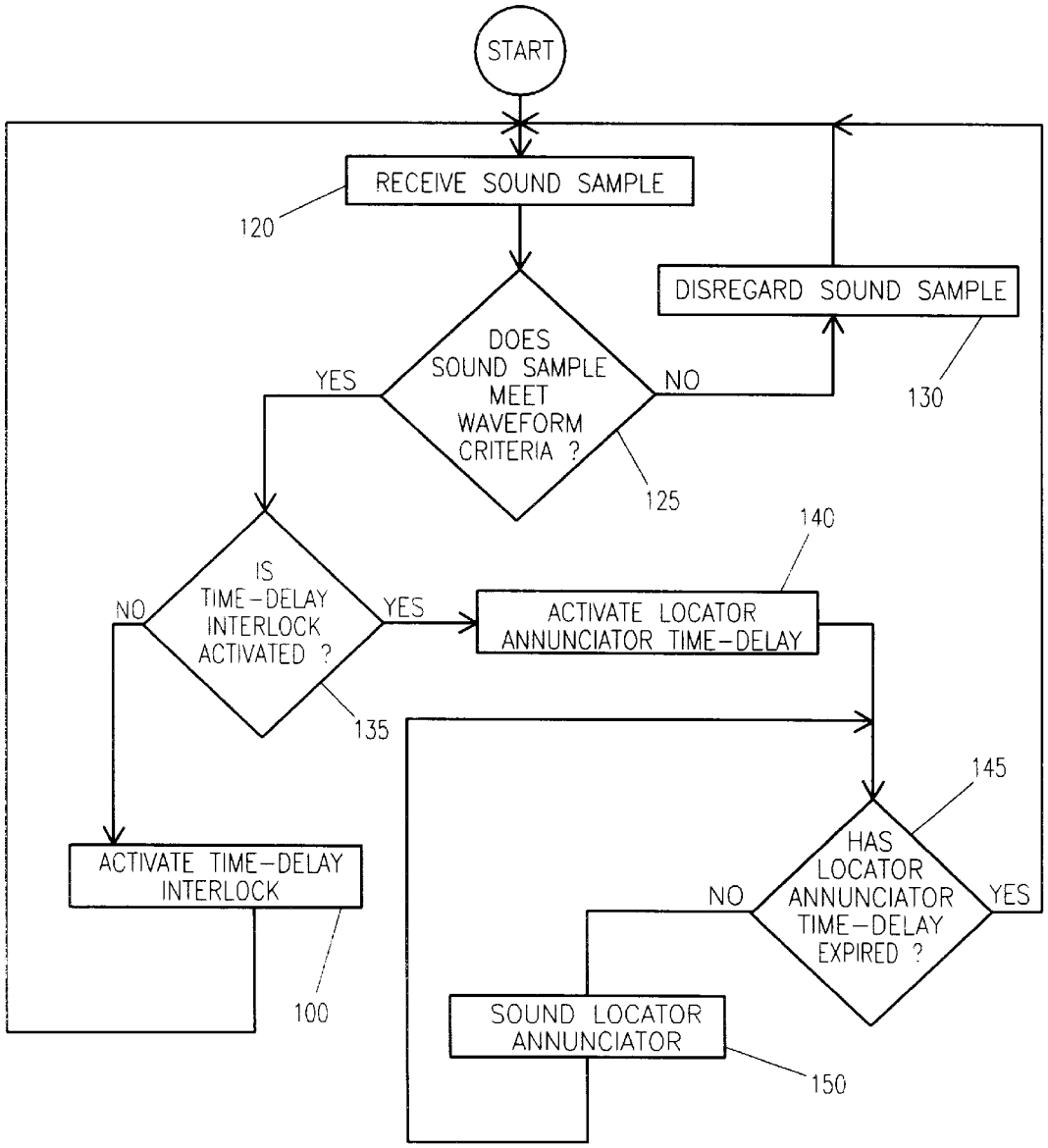
FIG. 4 is a flow chart diagram of the logic of the electronic programmed circuit.

Referring finally to FIG. 4, a flow chart diagram of the logic of the electronic programmed circuit found inside the encapsulated electronics module 80 (not shown in this FIG.) is disclosed. The functions and methodology shown in FIG. 4 can be implemented as hard wired subroutines in the encapsulated electronics module 80 (not shown in this FIG.) and allow for further elaboration to of the schematic description of FIG. 3. At a block 120, the sequence of monitoring begins by reception of a sound sample. At an inquiry block 125 the sound sample is compared to a reference target sound sample using fuzzy logic sequences as aforementioned described. If there is no match the sequence then repeats through a block 130. If there is a match, an inquiry block 135 checks to see if another matched sound sample was received prior to the reception of the current matched sound sample. If not, the time-delay interlock 100 is activated and the sequence repeats through block 120. If there was a previous match within a predetermined time period, on the order of one second, audible annunciation of the locator signal begins by activation of a block 140 and its associated timing loop comprising an inquiry block 145 and block 150 which sounds the audible annunciation. Upon expiration of the timing loop, a negative signal from inquiry block 145 resets to block 120 to repeat the above process.

2. Operation of the Preferred Embodiment

In operation, the present invention can be easily activated and utilized by the common infant or baby care provider in a simple and effortless manner. To use the present invention with its preferred embodiment can best be described in conjunction with the perspective view of FIG. 1, the cross-sectional view of FIG. 2, the diagrammatic representation of the circuitry used to activate the pacifier with sound activated tone generator 5 of FIG. 3, and the flow chart diagram of the logic of the electronic programmed circuit found inside the encapsulated electronics module 80 of FIG. 4.

The pacifier with sound activated tone generator 5 would be utilized by the baby or infant in a usual and customary manner by providing comfort via sucking simulation on the nipple 10 and the circular press base 15. In the event the pacifier with sound activated tone generator 5 falls out of the infant or baby's mouth or is inadvertently misplaced, the care giver would produce a series of two sharp noises such as the clapping of hands or snapping of fingers to activate the locator annunciator circuit of FIG. 3 and FIG. 4. The care giver would then listen for the audible output locator signal produced by the speaker 70 within the pacifier with sound activated tone generator 5 and then quickly locate the physical location of the pacifier with sound activated tone generator 5. The pacifier with sound activated tone generator 5 would then be returned to the infant or baby to ensure his or her continued comfort via sucking simulation. The pacifier with sound activated tone generator 5 can be disassembled to allow for cleaning or sanitization without damaging internal electronic components.

The foregoing description is included to illustrate the operation of the preferred embodiment and is not meant to limit the scope of the invention. The scope of the invention is to be limited only by the following claims.

What is claimed is:

1. A pacifier comprising:

a conventional nipple for providing sucking comfort of infants and babies;

a circular press base attached to said nipple and forming a pair of arched openings;

a circular electronics housing area forming an inner cavity and affixed to said circular press base and having an outer circular portion of the circular electronics housing area with a plurality of sound openings in a linear array to aid in allowing sound waves to both enter and leave the circular electronics housing area; and sound activated tone utilizing fuzzy logic to allow for the detection of the desired trigger sound under high ambient noise conditions during the day, allowing triggering to be tighter or more stringent, and sound triggering at lower ambient noise levels or when sounds are spaced farther apart at night.

2. The pacifier of claim 1, wherein the implementation of said fuzzy logic will be implemented using custom electronic chips using circuitry selected from the group comprising VLSI construction and chips utilizing RISC.

3. The pacifier of claim 2, further comprising:

a handle attached to the circular electronics housing area.

4. The pacifier of claim 3, wherein said circular press base, said circular electronics housing area, and said handle are manufactured from injection molded plastic.

5. The pacifier of claim 2, wherein said sound activated tone generator comprises:

an encapsulated electronics module comprising integrated circuitry used to activate an audio tone generator via a remote sound trigger;

a speaker;

a battery for providing electrical power to said electronics module;

a microphone for communicating audio input to said electronics module;

a wiring harness for providing the necessary electrical communication connections between the battery, the microphone, the speaker and the encapsulated electronics module.

6. The pacifier of claim 5, wherein said integrated circuitry comprises:

a first amplifier for amplifying the electronic output of the microphone;

a discriminator circuit for monitoring the amplified output of said first amplifier for a sound wave of particular nature having a quick rise time and quick fall time and have a large peak amplitude, and when such a sound is detected by the discriminator circuit produces an output signal;

a time delay interlock for receiving said output signal from said discriminator circuit and generating an output activation signal;

a waveform generator for playing of a musical tune such as a child's lullaby or other similar noise;

a second amplifier for producing an audible sound to a speaker; and a locator annunciator for receiving said output activation signal applying electrical power to said waveform generator and said second amplifier to produce an audible sound out of said the speaker for a predetermined time period.

7. The pacifier of claim 6, wherein said time-delay interlock activates only when two such signals are detected within a predetermined time period such as to avoid false triggers thereof.

8. In a pacifier having a conventional nipple for providing sucking comfort of infants and babies and a circular press base attached to said nipple and forming a pair of arched openings, wherein the improvement comprises:

a circular electronics housing area forming an inner cavity and affixed to said circular press base and having an outer circular portion of the circular electronics housing area with a plurality of sound openings in a linear array to aid in allowing sound waves to both enter and leave the circular electronics housing area; and sound activated tone generator utilizing fuzzy logic to allow for the detection of the desired trigger sound under high ambient noise conditions during the day, allowing triggering to be tighter or more stringent, and sound triggering at lower ambient noise levels or when sounds are spaced farther apart at night.

9. In the pacifier of claim 8, wherein the improvement further comprises a handle attached to the circular electronics housing area.

10. The pacifier of claim 9, wherein said circular press base, said circular electronics housing area, and said handle are manufactured from injection molded plastic.

11. The pacifier of claim 9, wherein said sound activated tone generator comprises:

an encapsulated electronics module comprising integrated circuitry used to activate an audio tone generator via a remote sound trigger;

a speaker;

a battery for providing electrical power to said electronics module;

a microphone for communicating audio input to said electronics module;

a wiring harness for providing the necessary electrical communication connections between the battery, the microphone, the speaker and the encapsulated electronics module.

12. The pacifier of claim 11, wherein said integrated circuitry comprises:

a first amplifier for amplifying the electronic output of the microphone;

a discriminator circuit for monitoring the amplified output of said first amplifier for a sound wave of particular nature having a quick rise time and quick fall time and have a large peak amplitude, and when such a sound is detected by the discriminator circuit produces an output signal;

a time delay interlock for receiving said output signal from said discriminator circuit and generating an output activation signal;

a waveform generator for playing of a musical tune such as a child's lullaby or other similar noise;

a second amplifier for producing an audible sound to a speaker; and a locator annunciator for receiving said output activation signal applying electrical power to said waveform generator and said second amplifier to produce an audible sound out of said the speaker for a predetermined time period.

13. The pacifier of claim 12, wherein said time-delay interlock activates only when two such signals are detected within a predetermined time period such as to avoid false triggers thereof.

* * * * *